United States Patent [19]

Rendine

[11] Patent Number: 4,747,496

[45] Date of Patent: May 31, 1988

[54] PLASTIC BOTTLE PRESSURIZATION CLIP FOR MAINTAINING CARBONATION IN BEVERAGES

[75] Inventor: Raphael Rendine, 1411 Sycamore St., Connellsville, Pa. 15425

[73] Assignees: Raphael Rendine; Dennis James Rendine, both of Connellsville, Pa. ; part interest to each

[21] Appl. No.: 43,484

[22] Filed: Apr. 27, 1987

[51] Int. Cl.[4] ..... B65D 1/02; B65D 21/08; B65D 23/00

[52] U.S. Cl. ..... 215/101; 215/100 R; 24/570

[58] Field of Search ..... 215/100 R, 101, 1 C; 220/85 H, 85 R; 224/148; 222/103, 95; 24/570, 35, 3 L

[56] References Cited

U.S. PATENT DOCUMENTS

| | | | |
|---|---|---|---|
| 52,373 | 1/1866 | Ireland | 215/101 X |
| 337,713 | 3/1886 | Snypp | 215/101 X |
| 2,088,387 | 7/1937 | Rice, Jr. et al. | 215/101 |
| 2,390,314 | 12/1945 | Massey | 222/103 |
| 3,269,603 | 8/1966 | Reimann | 222/103 |
| 4,456,134 | 6/1984 | Cooper | 215/1 C X |
| 4,627,546 | 12/1986 | Carranza | 220/85 H X |

FOREIGN PATENT DOCUMENTS

| | | | |
|---|---|---|---|
| 2539014 | 7/1984 | France | 215/1 C |

*Primary Examiner*—William Price
*Assistant Examiner*—Sue A. Weaver
*Attorney, Agent, or Firm*—Jon M. Lewis

[57] ABSTRACT

A device is used to squeeze side walls of a flexible bottle containing a carbonated beverage. The device is preferably a generally horseshoe-shaped clip having an arched portion, two parallel legs extending from the arched portion, and end tips flaring outwardly from each of the two parallel legs. The perpendicular distance between the two parallel legs is less than the diameter of the flexible bottle. Sufficient pressure is maintained inside the flexible bottle so that the beverage contained therein remains carbonated. The pressure maintained inside the flexible bottle is in the range of three to five psi.

6 Claims, 1 Drawing Sheet

PLASTIC BOTTLE PRESSURIZATION CLIP FOR MAINTAINING CARBONATION IN BEVERAGES

FIELD OF INVENTION

The present invention relates to a clip-on device for use with a carbonated beverage bottle to keep its liquid contents under pressure after a closure cap is removed and the contents are partially used.

BACKGROUND OF THE INVENTION

Carbonated beverages in flexible plastic bottles have the tendency to become flat and tasteless within a couple days after the sealed closure cap is broken, thus making storage undesirable for longer periods of time.

There are no satisfactory solutions known for the problem of maintaining the effervescence and flavor of the carbonated beverage after the flexible plastic bottle is opened. However, from a structural standpoint vis-a-vis the present invention, flexible devices are known to function as handles or holders for containers which are either rigid or flexible. Such structurally similar but functionally different devices are exemplified by the apparatuses shown and described in U.S. Pat. Nos. 4,627,546; 2,088,387; 337,713 and 52,373. Nevertheless, none of these devices are disclosed or suggested as capable of functioning to apply sufficient pressure to the side walls of a flexible bottle so that the liquid in such bottle is maintained in a carbonated state.

SUMMARY OF INVENTION

A flexible clip is intended to be applied to the side walls of a flexible plastic bottle containing a carbonated beverage in order to maintain the liquid in the bottle under pressure, thereby retaining the carbonation of the beverage. The clip itself puts the contents of the bottle under a pressure in the range of three to five pounds per square inch (psi) which is sufficient to preserve the carbonation of the beverage.

The preferred clip is made of a flat strip of flexible plastic or metal formed in the shape of a horseshoe with the distance between the parallel legs being less than the diameter of the flexible plastic bottle so that the side walls of such bottles are squeezed inwardly when the clip is applied to the body of the bottle, thus reducing the internal volume in which the carbonated beverage is contained. The tips of the horseshoe-shaped clip flare outwardly so that the flexible plastic bottle may be easily slipped into and out of the arched portion of the clip without puncturing or otherwise damaging the soft body of the flexible plastic bottle.

Major advantages of the present invention are that it is inexpensive to manufacture and simple to use. These and other advantages of the invention will be more fully understood from the following description of the drawing and the preferred embodiment.

DETAILED DESCRIPTION OF THE PREFERRED EMBODIMENTS

Figure 1:
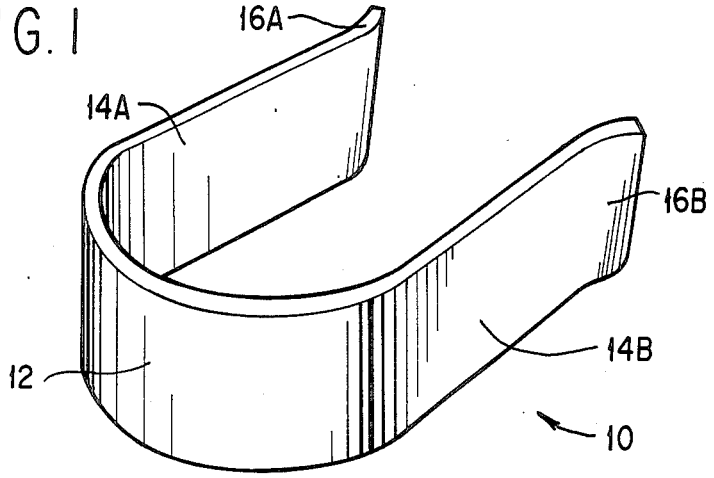
FIG. 1 is a perspective view of the present invention.

In FIG. 1 there is generally shown a horseshoe-shaped clip 10 having an arched portion 12, two parallel legs 14A and 14B, and two outwardly flaring end tips 16A and 16B. The clip 10 is a bent flat strip made of any flexible plastic stronger and harder than the plastic in the bottle containing the carbonated beverage.

Figure 2:
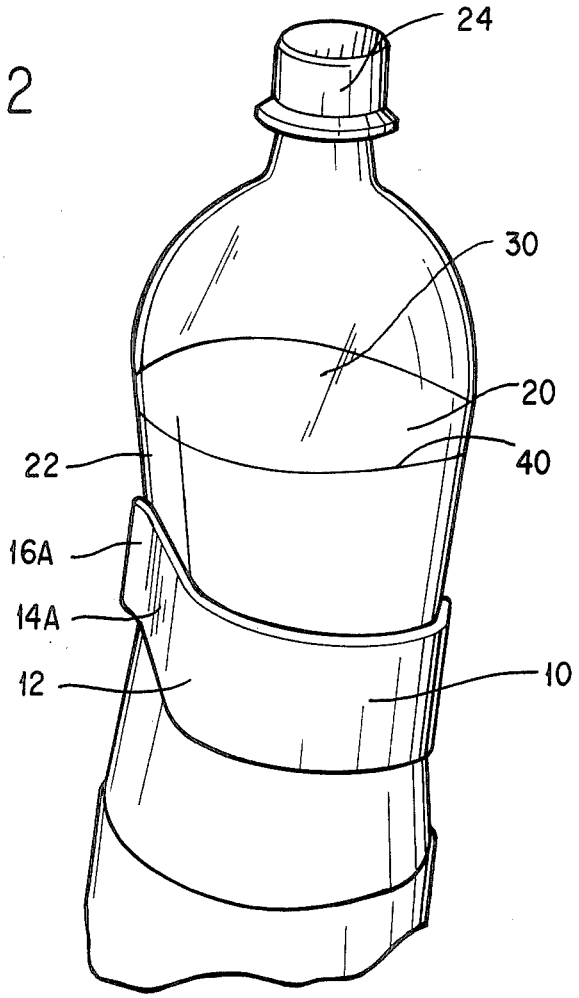
FIG. 2 is a view of the present invention in use on a flexible plastic bottle containing a carbonated beverage.

In FIG. 2 the clip 10 is shown in use on a flexible plastic bottle 20 having a generally cylindrical shape. The slip 10 is preferably slipped around central side walls 22 which are squeezed inwardly so that the internal volume of the bottle 20 is reduced, thus allowing air 30 above liquid 40 to remain in a desirable range of three to five psi. The side walls 22 are squeezed inwardly because the distance between the two legs 14A and 14B is less than the diameter of the bottle 20 because the outwardly flaring end tips 16A and 16B facilitate the gradual squeezing of the bottle 20 until such bottle 20 is held in the arched portion 12 of the clip 10. A cap 24 seals the top of the bottle 20 against escape of the air 30 and the liquid 40.

In order to use the clip 10 after each opening of the bottle 20, a user must first be certain that such bottle 20 is restored to its original shape with no obvious distortions. Then the user must tightly resecure the cap 24 onto the bottle 20. Finally, the user must gently push the clip 10 fully onto the midsection of the bottle so that the side walls 22 are squeezed into the arched portion 12 of the clip 10. This procedure should be repeated after each opening of the bottle 20 in order to keep the air 30 under sufficient pressure, thus maintaining the carbonation, flavor, and effervescence of the liquid 40.

It must be noted that the clip 10 should not be used on the bottle 20 until approximately one cup of the liquid 40 has been removed and replaced by air 30. The clip 10 can be made in different sizes in order to fit any volume of flexible plastic bottle. The clip 10 is particularly intended for use with such bottles containing either one, two, or three liters of carbonated beverage. For example, the perpendicular distance between the parallel legs 14A and 14B of the clip 10 may preferably be 1 $\frac{7}{8}$" for squeezing a one liter bottle; 3" for a two liter bottle; and 3 $\frac{3}{4}$" for a three liter bottle. The radius of the arched portion 12 for each of these clips 10 for use with bottles of different sizes is about half of the distance between the parallel legs 14A and 14B. The radius for the arcs which form the outwardly flaring tips 16A and 16B is about the same as the radius for the arched portion 12.

The foregoing preferred embodiment is considered illustrative only. Numerous other modification and changes, will readily occur to those persons skilled in related arts after reading this disclosure. Consequently, the present invention is not limited to the exact construction and operation shown and described hereinabove, but rather is defined by the claims appended hereto.

I claim:

1. A device for squeezing side walls of a flexible bottle containing a carbonated beverage, comprising a generally horseshoe-shaped clip having an arched portion, two parallel legs extending from the arched portion, and end tips flaring outwardly from each of the two parallel legs, wherein the perpendicular distance between the two parallel legs is less than the diameter of the flexible bottle, whereby sufficient pressure is maintained inside the flexible bottle so that the beverage contained therein remains carbonated.

2. The device according to claim 1 wherein the pressure maintained inside the flexible bottle is in the range of three to five psi.

3. Means for squeezing side walls of a flexible bottle containing a carbonated beverage comprising a device having two parallel legs, wherein the perpendicular distance between the two parallel legs is less than the diameter of the flexible bottle, whereby sufficient pressure is maintained inside the flexible bottle so that the beverage contained therein remains carbonated, having end tips flaring outwardly from each of the two parallel legs so that slippage of the flexible bottle into a space between the two parallel legs is facilitated.

4. Squeezing means according to claim 3, wherein the pressure maintained inside the flexible bottle is in the range of three to five psi.

5. A device for squeezing side walls of a flexible bottle containing a carbonated beverage, comprising means for maintaining sufficient pressure inside the flexible bottle so that the beverage contained therein remains carbonated, wherein the pressure maintaining means includes two parallel legs having a perpendicular distance therebetween, said distance being less than the diameter of the flexible bottle, and further, wherein there are end tips flaring outwardly from each of the two parallel legs so that slippage of the flexible bottle into a space between the two parallel legs is facilitated.

6. The device according to claim 5, wherein the pressure maintained inside the flexible bottle is in the range of three to five psi.

* * * * *